US005116045A

United States Patent [19]

Jahoda

[11] Patent Number: 5,116,045

[45] Date of Patent: May 26, 1992

[54] SPORTS MAT, NOTABLY A MOVABLE JUDO MAT

[76] Inventor: Frantisek Jahoda, Am Schreiberg 7, A-5201 Seekirchen, Austria

[21] Appl. No.: 473,999

[22] PCT Filed: Apr. 14, 1989

[86] PCT No.: PCT/EP89/00402

§ 371 Date: Apr. 17, 1990

§ 102(e) Date: Apr. 17, 1990

[87] PCT Pub. No.: WO90/03202

PCT Pub. Date: Apr. 5, 1990

[30] Foreign Application Priority Data

Sep. 23, 1988 [AT] Austria ..... 2355/88

[51] Int. Cl.[5] ..... A63B 6/00; A63B 71/04

[52] U.S. Cl. ..... 472/92; 5/420; 5/450; 482/30; 482/51; 482/146

[58] Field of Search ..... 272/65, 93, 109, 101, 272/102, 144, 146, 70; 5/417, 420, 431, 446, 447, 448, 449, 450, 464, 474, 481

[56] References Cited

U.S. PATENT DOCUMENTS

| | | | |
|---|---|---|---|
| 3,024,021 | 3/1962 | Coplin et al. | 272/146 |
| 3,319,273 | 5/1967 | Solin | 5/420 |
| 3,649,974 | 3/1972 | Baruth et al. | 5/474 |
| 3,806,968 | 4/1974 | Robey | 5/446 |
| 4,037,834 | 7/1977 | Oaks | 272/65 |
| 4,222,137 | 9/1980 | Usami | 5/446 |
| 4,245,836 | 1/1981 | Gordon | 272/104 |
| 4,357,724 | 11/1982 | LaForest | 5/449 |
| 4,491,318 | 1/1985 | Frande | 272/146 |
| 4,687,198 | 8/1987 | Smith | 272/114 |

FOREIGN PATENT DOCUMENTS

| | | | |
|---|---|---|---|
| 2592802 | 7/1987 | France | 272/93 |

*Primary Examiner*—Richard J. Apley
*Assistant Examiner*—Karen G. Horowitz
*Attorney, Agent, or Firm*—Collard, Roe & Galgano

[57] ABSTRACT

The invention relates to a sports mat, especially a judo mat, of an elastic foam-like material (4) and possibly a sheath (7). According to the invention, the elastic foam-like material (4) is arranged on a stiff approximately circular plate (3) which has a central projection (5) on the underside and is fitted so as to "float" on a yielding foam (6).

11 Claims, 2 Drawing Sheets

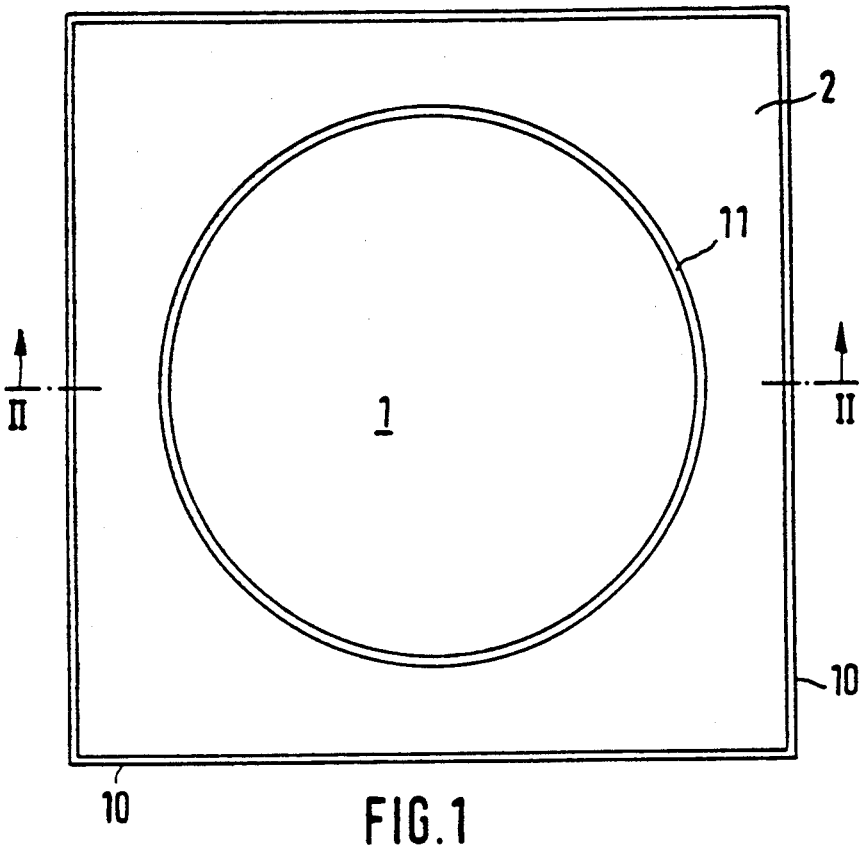
FIG. 1
FIG. 2
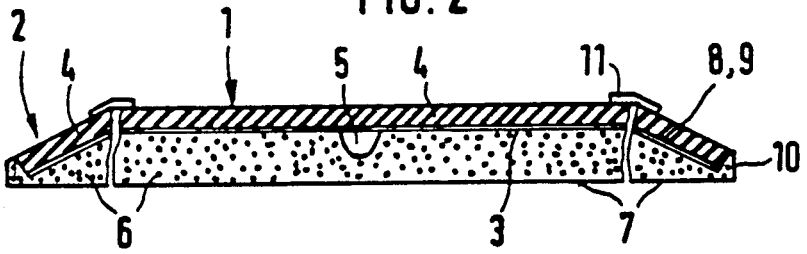

SPORTS MAT, NOTABLY A MOVABLE JUDO MAT

The invention concerns a sports mat, notably a movable judo mat made of an elastic foam-like material and, if desired, an elastic cover.

Such sports mats are known in many sizes and thicknesses and are used in many types of sports in order to prevent injuries. The core of such mats consists of a cellular structure. The surfaces have a closed structure, for example, a sealed or imperforate surface. The imperforate surface may be provided by a separate elastic cover. Depending on the structure and the material selected, mats with a characteristic from soft to hard (i.e., a range of elastic characteristics) can be manufactured. To prevent the mat from sliding, the surface of the cover, or of the elastic foam-like material, can be structured, for example in the form or nubs, on its bottom as well as for one or several users. These mats will dampen a shock, a fall, a landing, etc. of one or several athletes in various types of sport such as judo or aikido.

In many types of sport, however, it is important, such as in judo, to be able to recognize shifts in weight, for instance from both legs to one leg, in order to be able to devise an effective attack or defense.

SUMMARY OF THE INVENTION

It is therefore an object of the present invention to provide a sports mat, notably a movable judo mat, that is improved in the sense that, besides preventing injuries, it makes it possible to recognize weight shifts of one or several users.

This object is achieved according to the invention by the provision of a mat made of an elastic foam-like material and, if desired, a cover for the foam-like material. The foam-like material is placed on a generally stiff circular platform. The underside of the platform has a central projection. The platform is resiliently supported by the displaceable foam material. A skirt may be provided for placement around the platform, which can optionally be covered with an elastic foam-like material.

On the basis of an implementation example, the invention is described in more detail below, referring to schematic drawings and pointing out alternative forms of construction, and citing specific advantages. The figures show:

FIG. 1 A movable judo mat seen from above;

FIG. 2 A cross section II—II based on FIG. 1;

FIG. 3 A judo mat of alternative construction with a central load;

FIG. 4 The mat of FIG. 3 with a lateral load.

Figure 3:
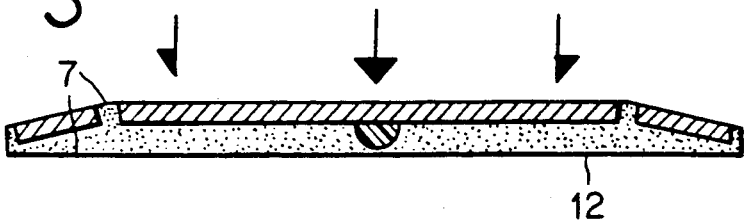

The movable judo mat according to FIGS. 1 and 2 consists of a central, approximately circular section 1 surrounded by a skirt 2 whose circumference is square in the example, but that can also be circular, oval, rectangular, or polygonal, such as pentagonal or hexagonal, and can also consist of combinations of round, straight, and angular sections.

As shown in FIG. 2, the central section 1 is of sandwich construction and features a circular platform 3 consisting of a material of relatively high bending resistance, such as a platform of wood, plastic, or metal of sufficient stiffness, which may also consist of several layers like a sandwich, also including elastic layers (not shown) with no bending resistance.

The circular platform 3 is covered with an elastic foam-like material 4 such as is commonly used in known sports mats. The elastic foam-like material 4 can be attached to the circular platform 3 in a permanent or detachable manner. A detachable arrangement has the advantage of being able to use mats of various thicknesses and/or hardness/softness characteristics.

At the center of the circular platform 3, which should also be the center of gravity of the platform 3, the platform carries a projection 5 in the form of a hemisphere. The projection 5 can also be of conical shape, preferably having a rounded tip (not shown). The circular platform 3 with its projection 5 is "floatingly" supported by a displaceable foam material 6. A displaceable foam material 6 is meant to be a material that can dissipate or evade pressure when loaded unilaterally, i.e., can "flow away" and/or is compressible or extensible. To increase the damping properties of the sports mat, the displaceable foam material 6 can also have flow, compression, and extension properties. Also, a conventional sports mat material can be used as a displaceable foam material.

When the central section 1 is not loaded, the projection 5 is also supported by displaceable foam material 6 (see FIG. 2). The projection 5 can consist of a hard, practically rigid material such as wood, metal, or plastic, but may also consist of a material having certain elastic properties, such as hard rubber or corresponding plastics, which will impart additional damping properties to the sports mat during use. The displaceable foam material 6 can be placed in a casing 7 that will preferably consist of a flexible, but practically nonextensible material, so that the displaceable foam material 6 can shift inside the casing 7 but can practically not change its volume. However, it is certainly possible to make at least portions of the casing 7 of an elastic, extensible material as well, particularly if the displaceable foam material 6 has a skeleton structure that in practice allows only up-and-down movements and no, or only small, lateral movements.

Figure 5:
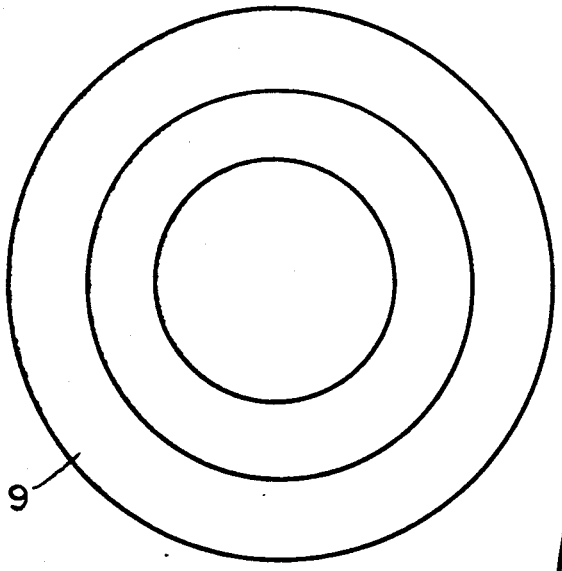
FIG. 5 is a plan view of the reinforcing elements.
Figure 6:
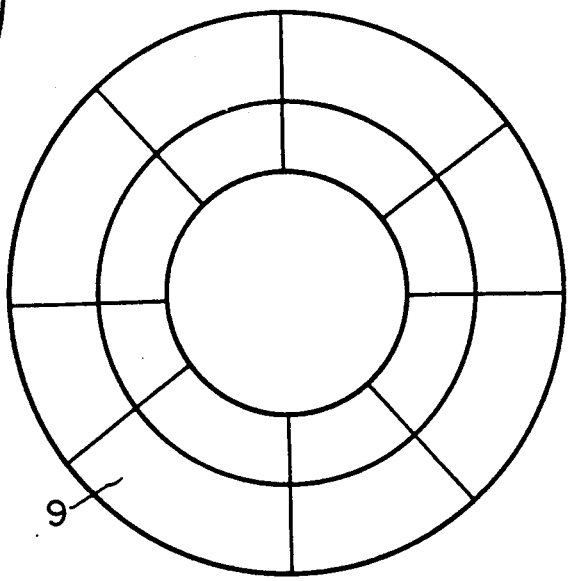
FIG. 6 is a plan view of another embodiment of the reinforcing elements.

In the application example according to FIGS. 1 and 2, the construction of the skirt 2 is analogous to that of the central section 1. It carries a reinforcement 8, which can consist, for instance, of several concentric rings or disks that may be connected to each other in a rigid or articulated manner or not at all (see FIG. 5). However, the reinforcement 8 can also consist of platforms 9 arranged radially, or of rods (see FIG. 6), which may also be interconnected in one or more places, in an articulated or rigid manner or not at all. The reinforcement 8 can carry elastic, foam-like material 4 on top and displaceable foam material 6 underneath. Preferably, the thickness of the skirt 2 will decrease toward its outer edge 10. Also, the skirt 2 can consist only of elastic, foam-like material 4, which can also be composed of two or more layers of differing hardness or softness characteristics. In the application example of FIGS. 1 and 2, the sports mat consists of a separate skirt 2 into which the central section 1 can be fitted, such that the height of the central section 1 in an unloaded condition corresponds to the height of the inside edge of the skirt 2. In order not to create edges between the central section 1 and the skirt 2, even though they may be elastic, their connecting line is covered, for example, by a covering tape 11 connecting the skirt 2 and the central section 1 rigidly, e.g., by means of a glued joint, or detachably, e.g., by means of a hook and loop fastener (such as that sold under the trademark VELCRO) making for a smooth transition between the central section 1 and the skirt 2.

Figure 4:
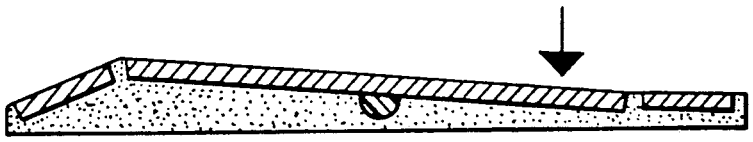

The application example shown in FIGS. 3 and 4 is of a construction corresponding to the one described by FIGS. 1 and 2, except that the central section 1 forms one unit with the skirt 2, so that the displaceable foam material 6 of the skirt 2 and of the central section 1 is placed in a common casing 7. The skirt 2 is connected to the central section 1 by, for instance a covering material.

With a central or evenly balanced load (see the arrow in FIG. 3), the sports mat is compressed evenly, so that the circular platform 3 approaches the bottom surface 12 parallel with the latter, and can rest on it when the load becomes extreme. If the load is applied outside of the center (see the arrow in FIG. 4), a material movement will occur in the form of a compression on one side and an extension/expansion on the other side, so that the stiff platform 3 will carry out a tilting motion with the projection 5 serving as a fulcrum. Due to the hinge-like attachment of the skirt 2 to the central section 1, the skirt 2 is flattened in the area of loading and built up in the area of unloading (see FIG. 4). The motion as described by means of the displaceable foam material 6 can occur not only through a compression on one side and a corresponding expansion on an opposite side, but also through an actual material flow of the displaceable foam material 6, with the casing 7 being of constant volume or, by using an elastic, extensible material, of changeable volume as well.

The sports mat according to the invention can be used specifically as a judo mat, not only for learning practically all of the judo throws, but also to develop action and reaction sequences with the corresponding motion stereotypes. In this manner, the teacher can make the student understand tension and pressure relationships at various positions of the center of gravity or load distribution. In addition, the sports mat is useful in perfecting special techniques and expanding the repertoire of throws. In this manner, the learning of appropriate action and reaction sequences is promoted, and appropriate reflexes can be developed within a much shorter period than heretofore.

I claim:

1. A sports mat comprising:

a generally circular rigid platform with a top side and a bottom side;

an elastic foam-like material which is placed on said top side of said platform;

a generally centrally-disposed, downwardly-depending projection which is located on said bottom side of said platform and which serves as a fulcrum when said mat is subject to a load;

a displaceable foam material which resiliently supports said platform and said projection in an unloaded state; and which is partially compressed in a loaded state so as to permit movement of said projection as a fulcrum; and a skirt which surrounds said platform and is made at least partly of an elastic foam-like material.

2. The sports mat as claimed in claim 1, further comprising:

a casing which holds said displaceable foam material.

3. The sports mat as claimed in claim 2, wherein said projection has the shape of a hemisphere.

4. The sports mat as claimed in claim 3, wherein said skirt is connected to said platform in an articulated manner.

5. The sports mat as claimed in claim 4, wherein said skirt is resiliently supported on a second displaceable foam material.

6. The sports mat as claimed in claim 5, wherein said displaceable foam material and the second displaceable foam material forms one unit.

7. The sports mat as claimed in claim 6, wherein said skirt further comprises a reinforcement which is placed between said second displaceable foam material and said elastic foam-like material.

8. The sports mat as claimed in claim 7, wherein the thickness of said skirt decreases toward its outer edge.

9. The sports mat as claimed in claim 8, further comprising a flexible casing which holds said displaceable foam material.

10. The sports mat as claimed in claim 9, wherein said flexible casing is partly resistant to changes in volume.

11. The sports mat as claimed in claim 10, wherein said displaceable foam material is removably set in said casing so as to be replaceable.

* * * * *